US005774094A

United States Patent [19]

Yonezaki

[11] Patent Number: 5,774,094

[45] Date of Patent: Jun. 30, 1998

[54] COMPLEMENTARY BOWTIE ANTENNA

[75] Inventor: Michael S. Yonezaki, Torrance, Calif.

[73] Assignee: Raytheon Company, Lexington, Mass.

[21] Appl. No.: 699,304

[22] Filed: Aug. 19, 1996

[51] Int. Cl.[6] ..... H01Q 13/10

[52] U.S. Cl. ..... 343/770; 343/725; 343/767

[58] Field of Search ..... 343/700, 795, 343/807, 792.5, 808, 828, 725, 767, 770

[56] References Cited

U.S. PATENT DOCUMENTS

| | | | |
|---|---|---|---|
| 3,193,831 | 7/1965 | Yang | 343/792.5 |
| 3,721,990 | 3/1973 | Gibson et al. | 343/795 |
| 3,868,694 | 2/1975 | Meinke | 343/785 |
| 3,906,506 | 9/1975 | Verma et al. | 343/876 |
| 4,435,072 | 3/1984 | Adachi et al. | 355/3 FU |
| 5,166,697 | 11/1992 | Viladevall et al. | 343/727 |
| 5,461,392 | 10/1995 | Mott et al. | 343/767 |

*Primary Examiner*—Donald T. Hajec
*Assistant Examiner*—Tho Phan
*Attorney, Agent, or Firm*—Leonard A. Alkov; Glenn H. Lenzen, Jr.

[57] ABSTRACT

A low frequency, complementary bowtie antenna structure, including a resistive film, a sheet of silicon impregnated with ferrite material and a sheet of rigid dielectric foam. The film has a linearly tapered resistive coating applied to a surface, and is cut in the shape of a complementary bowtie radiator. A center conductor of a feed coaxial line is soldered to the most conductive section of the resistive material. The outer conductor of the coaxial line is connected to a ground plane. The antenna structure can be used in a conformal, L-band array of bowtie radiators which can be integrated into an X-band array aperture with minimal impact on the radiation and RCS performance of the X-band array.

5 Claims, 1 Drawing Sheet

COMPLEMENTARY BOWTIE ANTENNA

TECHNICAL FIELD OF THE INVENTION

This invention relates to radar antennas, and more particularly to an array of bowtie radiators which can be integrated into an array of X-band radiators to provide low frequency functions with minimal impact on the radiation and RCS performance of the X-band array.

BACKGROUND OF THE INVENTION

There are radar system applications, such as airborne systems for fighter aircraft, which have a need to provide multiple functions within a single aperture. In addition, minimization of the radar cross section (RCS) is a high priority on many new radar programs. There is therefore a need for a radiating element which can be integrated into an X-band array aperture to provide a lower frequency band function with minimal impact on the radiation and RCS performance of the X-band array.

SUMMARY OF THE INVENTION

A complementary bowtie antenna is described, which comprises a resistive film formed on a dielectric sheet, the film characterized by a resistivity which is linearly tapered from a low resistivity at a feed edge to a high resistivity at a radiating edge. The film is cut in a bowtie pattern. The antenna further includes a sheet of silicon loaded with ferrite, the dielectric sheet and silicon sheet being sandwiched together. A feed circuit is electrically connected to the resistive film at a position on the film having the lowest resistivity. A ground plane is situated adjacent the resistive film on the same plane.

The antenna according to the invention can be integrated into an antenna aperture of an X-band array, such as an array of flared notch radiating elements.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
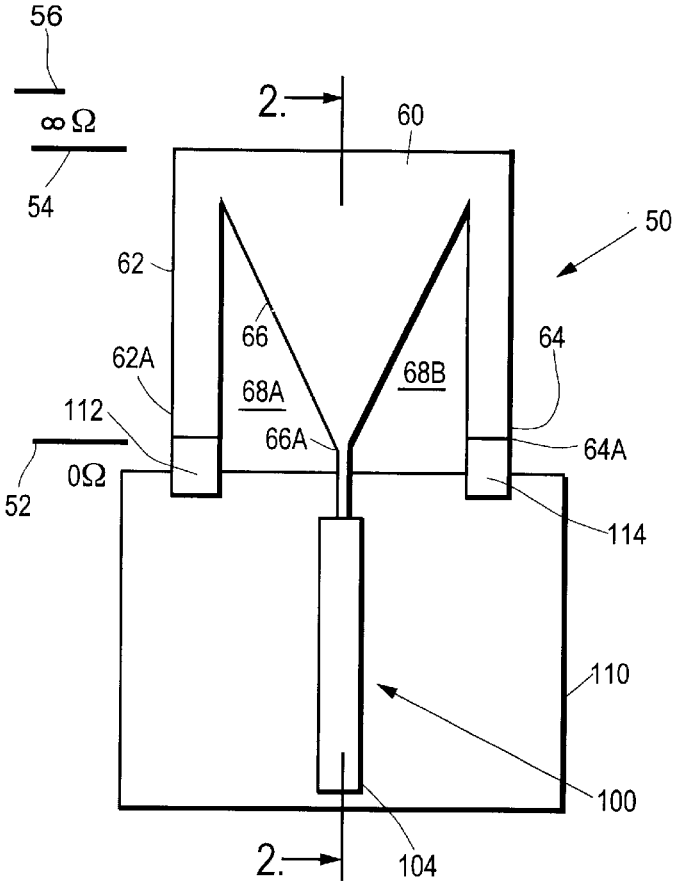
FIG. 1 is a simplified top view of a complementary bowtie radiating element embodying this invention.
Figure 2:
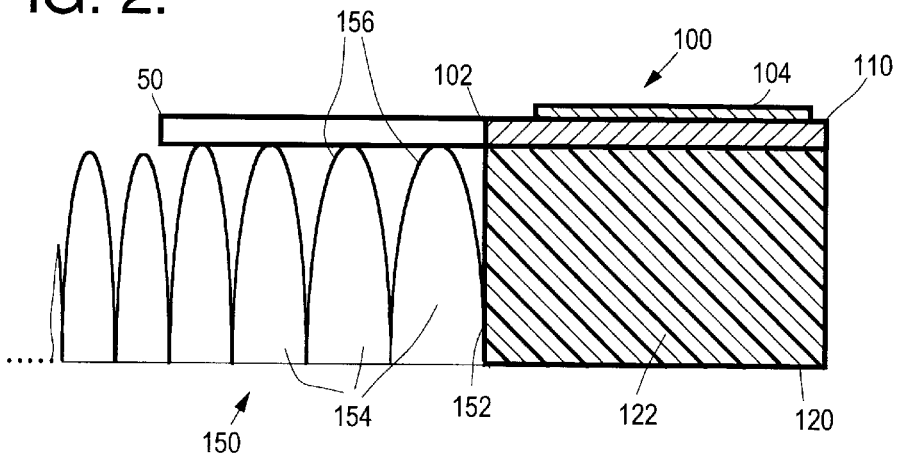
FIG. 2 is a cross-sectional side view taken along line 2—2 of FIG. 1.
Figure 3:
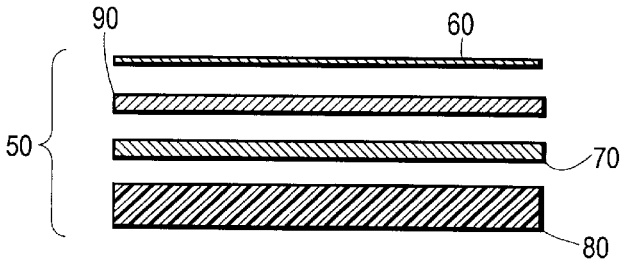
FIG. 3 is an exploded side view showing elements of the complementary bowtie radiating element of FIG. 1.

A complementary bowtie radiating element 50 in accordance with the invention is shown in FIGS. 1–3. This radiating element represents a pseudo "complementary" bowtie element because, while its conductive pattern is the complement of the conductor pattern defining a conventional bowtie radiating element, the fields generated by this complementary bowtie radiating element are similar to those generated by the conventional bowtie radiating element. In contrast, a true "complementary" antenna would generate an electric field that is rotated by 90 degrees from that generated by its complement.

The radiating element 50 of this exemplary embodiment includes a resistive film 60, a sheet 70 of silicon impregnated with ferrite material, a sheet 80 of rigid dielectric foam such as that marketed under the trademark STYROFOAM, and a thin sheet of a dielectric such as fiberglass.

The resistive film 60 comprises a resistive coating deposited onto a thin dielectric sheet, which in an exemplary embodiment is a layer of Mylar (™) about 8 mils in thickness. The film 60 is supported by the fiberglass sheet 90, and can be adhered to the sheet 90 by an adhesive such as "Spray Mount" cement available from the 3M Company. The coating on the resistive film 60 is formed in the shape of a portion of a complementary bowtie radiator, as shown in FIG. 1, with triangularly-shaped regions 68A and 68B having no resistive coating applied thereto. (Alternatively, the bowtie shape can be formed by cutting out the triangular regions 68A and 68B from the Mylar film)

The resistivity of the coating applied to the resistive film 60 varies along a gradient as shown in FIG. 1, from 0 ohms per square inch at edge 52 to infinite ohms per square inch resistance at edge 54. The complementary bowtie shape defines outer resistive coating strips 62 and 64, and interior triangular region 66, which defines apex 66A.

The sheet 70 can be fabricated from a commercially available material marketed as MAGRAM by GEC Marconi Materials, Co., 9630 Ridge Haven Court, San Diego, Calif. 92123, as part number 9641. In an exemplary embodiment, the sheet 70 has a thickness of about 40 mils. As an alternative to a sheet of silicon impregnated with ferrite material, other dielectric materials which are absorptive of microwave energy could alternatively be used, such a foam absorbers, syntactic foam absorber, honeycomb absorber structures, and the like.

The dielectric foam layer 80 is used as a spacer to fill the step formed by the tips 156 of the X-band flared notch radiating elements 154 comprising an X-band array 150 and the surrounding ground plane 110.

The radiator 50 further includes a planar ground plane 110 disposed adjacent the low resistivity edge 62. The radiator 50 is excited by soldering the center conductor 102 of an 0.85 inch coaxial line 100 to the most conductive section of the resistive material, at apex 66. The outer conductor 104 of the coaxial line is soldered to copper tape which is then attached, e.g. by soldering, to the ground plane 110. Similarly the tips 62A and 64A of strip regions 62 and 64 are soldered to copper tape elements 112 and 114, respectively, which are attached by soldering to the ground plane 110.

Mounting structure 120 supports the ground plane 110 of the antenna 50 adjacent the edge 152 of the X-band array 150, so that the assembly of elements 60, 60, 80 and 90 is cantilevered over the tips of the flared notches 154 from the edge 152. The structure 120 holds radar absorbent material 122 below the ground plane 110. Only a few of the elements of the array 150 are shown in FIG. 2; similarly, a plurality of the complementary bowtie antennas 50 can be disposed along the edge 152, depending on the requirements of a particular application.

In an exemplary application for L-band operation, the bowtie pattern can have the following exemplary dimensions, an overall width dimension of 9.00 cm, an overall height dimension of 7.62 cm (distance from the feed edge 52 to top edge 56), distance from edge 52 to the apex of region 68A of 6.63 cm, and distance between the inside edges of strips 62 and 64 of 7.0 cm. Thus, for L-band operation centered at 1 GHz, the dimensions of the radiator are all less than one half wavelength in this exemplary embodiment. Of course, one could chose to build a larger radiator. The compactness of the radiator is an advantage, particularly when integrating the radiator into a dual band antenna system, as illustrated in FIG. 2.

The resistive coating provided by layer 60 "softens" the effects of a metal edge, making the bowtie antenna operate as if it has no metal edges, i.e. like an infinite length antenna. The ferrite layer 70 provides tuning, and helps to isolate the bowtie antenna 50 from the X-band array 150.

The complementary bowtie antenna of this invention can be compared to a slot or bowtie with "legs," i.e. the strips 62 and 64 (FIG. 1). The shape of a slot in a ground plane would resemble a bowtie and the electric fields produced by the bowtie would be similar to those of a conventional slot being excited across its smaller dimension. In the present invention, only half of the "slot" is formed, i.e. half of the bowtie, since the other half is formed by its electrical image on the ground plane 110. Alternatively, the antenna of this invention can be compared to a conventional bowtie, which does not have the "legs". Again however, only half of the bowtie is formed since the other half is formed by its electrical image. Moreover, neither the slot nor the conventional bowtie involves the tapering of the conductivity away from the feed point, as in this invention.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A dual band antenna system, comprising:

a first antenna system comprising an array of flared notch radiating elements arranged in an antenna aperture for operation at X-band frequency, and a second antenna system for operation at L-band frequency, said second antenna system including a complementary bowtie antenna comprising:

a resistive film formed on a dielectric sheet, the film characterized by a resistivity which is tapered from 0 ohms per square inch resistivity at a feed edge to infinite ohms per square inch resistivity at a second edge, the film formed in a complementary partial bowtie pattern, wherein the absence of resistive film forms the bowtie pattern, wherein the partial bowtie pattern is bordered by outer first and second strips of the resistive film extending transversely to the feed edge, and wherein tips of the strips at the feed edge are connected to ground, and wherein said dielectric sheet of said complementary bowtie antenna is disposed adjacent said tips of said flared notch radiating elements;

a layer of silicon impregnated with ferrite material disposed adjacent said dielectric sheet;

a feed circuit electrically connected to the resistive film at a position on the film having the lowers resistivity; and a ground plane structure disposed along the feed edge and in a generally planar relationship with the resistive film, and wherein said tips of said strips are connected to said ground plane; and wherein the bowtie antenna is disposed along a peripheral edge of the aperture.

2. The system of claim 1 wherein the position on the film having the lowest resistivity is located at a center of the bowtie pattern at the feed edge.

3. The system of claim 1 wherein the feed circuit includes a coaxial transmission line having a center conductor electrically connected to an apex, and an outer conductor electrically connected to the ground plane.

4. The system of claim 1 wherein said bowtie antenna further includes a dielectric layer of microwave absorbing material disposed adjacent said dielectric sheet.

5. The system of claim 1 wherein the partial bowtie pattern is a half bowtie pattern formed by two adjacent triangular regions free of resistive coating.

* * * * *